United States Patent [19]

Yang

[11] Patent Number: 5,044,933

[45] Date of Patent: Sep. 3, 1991

[54] WINDPROOF LIGHTER

[76] Inventor: James C. H. Yang, 2416 W. 231 St., Torrance, Calif. 90501

[21] Appl. No.: 441,471

[22] Filed: Nov. 27, 1989

[51] Int. Cl.[5] ..... F23Q 25/00

[52] U.S. Cl. ..... 431/144; 431/146; 431/151

[58] Field of Search ..... 431/144, 146, 151, 310

[56] References Cited

U.S. PATENT DOCUMENTS

| | | | |
|---|---|---|---|
| 1,720,460 | 7/1929 | Ament | 431/350 X |
| 2,491,861 | 12/1949 | Kaupmann | 431/151 X |
| 2,494,322 | 1/1950 | Ward | 431/151 X |
| 2,510,995 | 6/1950 | Mockel | 131/175 |
| 3,100,493 | 8/1963 | Rundle | 131/175 |

FOREIGN PATENT DOCUMENTS

| | | | |
|---|---|---|---|
| 383831 | 3/1921 | Fed. Rep. of Germany | 431/146 |
| 0027125 | 2/1984 | Japan | 431/146 |
| 88421 | 3/1921 | Switzerland | 431/152 |

OTHER PUBLICATIONS

WO88/01713, Mizukami, Mar. 1988.

*Primary Examiner*—Carl D. Price

*Attorney, Agent, or Firm*—Fleit, Jacobson, Cohn, Price, Holman & Stern

[57] ABSTRACT

A windproof lighter includes a windshield (44) with openings (443,444) facing the striker (43) and over the flame and nozzle area, edges on the openings, and rounded sides or flanges on the edges around the nozzle on the top edge of the butane well (3, 41), so that it is windproof by reducing the chance of flame extinguishment and is also scratch-proof and embodies simplification of construction. A shield (31) cover is provided over the windshield to prevent direct contact of the user with the windshield.

11 Claims, 2 Drawing Sheets

WINDPROOF LIGHTER

BACKGROUND OF THE INVENTION

This invention relates to a windproof lighter for preventing the flame from being blown out in use.

The design of a lighter should provide a device to prevent the flame from being extinguished by the wind, provide a safe operation, and simplify the construction for practical application. An example of a known windproof lighter is shown in U.S. Pat. No. 4,531,906 having a structure illustrated in FIG. 1, which mainly consists of a case member 1, a windshield member 2, and a regular disposable lighter 3 associated together. The case member 1 is suitably installed with the windshield 2 and the lighter member 3 in it. One side of the exterior of the case member 1 is equipped with an opening 13 so that the user can push up the windshield 2 to a suitable position in order to prevent the flames of the lighter 3 from blowing out.

The above U.S. Patent provides a case member 1 which has a larger volume than the regular disposable lighter and a slidable windshield 2, where the design of the windshield 2 is such that it can be pushed up and down easily between the inner wall of the case member 1 and the outer wall of the lighter 3, and can be manufactured easily. It is constructed as a flat panel on two side portions so that the edge usually is rather sharp. Some of these products can injure a user's skin because of their sharp and rough edges. The two side portions of the windshield 2 is that type of panel. When the wind is blowing toward the opening 13 of the case member 1 on the front side of the windshield 2 which is installed within the case member 1, the flames burning on the nozzle port 311 in the opening of the windshield 2 frequently are blown out because the air at the two side portions of the windshield 2 quickly flows into the opening of the windshield 2 due to the lower pressure air formed around the flames and the high pressure air generated by the wind flowing over the edges of the two side portions of the windshield 2. Therefore, although the regular disposable lighter is adapted for use with the case member 1 of the prior art lighter for windproof service, yet the windproof effect of the slidable windshield 2 is poor and it is easy to get injured by the sharp edges of the two side portions of the windshield or the rough surface, in addition to the disadvantage of the inconvenience due to the size being too big.

BRIEF SUMMARY OF THE INVENTION

The primary object of the present invention is to provide one type of windproof lighter which prevents or reduces the chances of the lighter flames being blown out by the wind.

A further object of the present invention is to provide one type of windproof lighter which prevents or reduces the chance of the user injuring his skin because of a sharp edge on the windshield.

Another object of the present invention is to provide one type of windproof lighter having simplified construction and installation such that the production cost is reduced.

The present invention provides one kind of practical windproof lighter utilizing a windshield with a rounded folding side, or flange, which reduces or decreases the air flowing into the windshield from the two side portions of the windshield, in order to reduce or prevent the possibility of the flame of the lighter being blown out. The invention also reduces or prevents the chance of the user's skin being injured due to the sharp edge of the windshield. Furthermore, the construction and installation are simplified and the production cost is reduced.

BRIEF DESCRIPTION OF THE DRAWINGS

The invention will now be described with reference to the accompanying drawings wherein.

DETAILED DESCRIPTION OF THE INVENTION

Figure 1A:
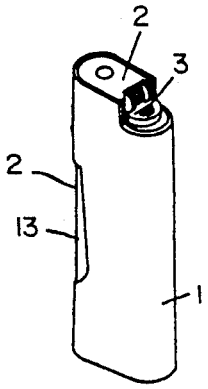
FIG. 1a (PRIOR ART)
FIG. 1*a* is a perspective view of a prior art lighter with the windshield member retracted.
Figure 1B:
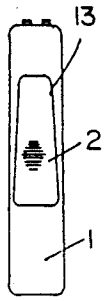
FIG. 1b (PRIOR ART)
FIG. 1*b* is a front side elevational view of FIG. 1*a;*
Figure 1C:
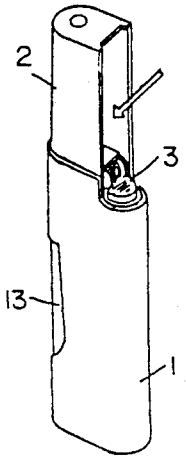
FIG. 1c (PRIOR ART)
FIG. 1*c* is a view similar to FIG. 1*a* showing the windshield raised.
Figure 1D:
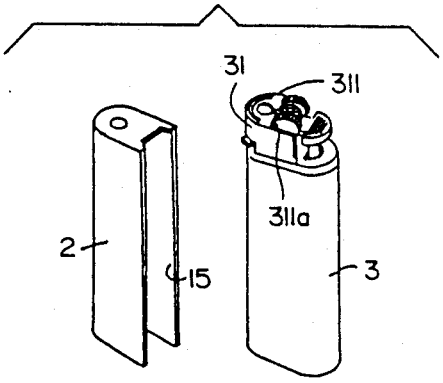
FIG. 1d (PRIOR ART)
FIG. 1*d* is an exploded perspective view of FIG. 1*a;*
Figure 1E:
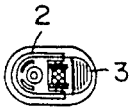
FIG. 1e (PRIOR ART)
FIG. 1*e* is a top plan view of the prior art lighter.
Figure 8:
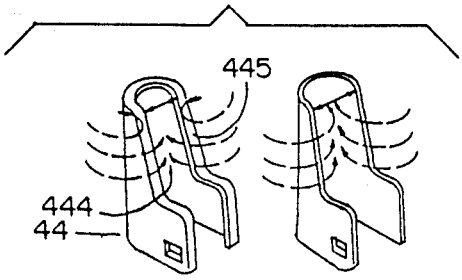
FIG. 8 is a perspective diagrammatic illustration of the effect of air flow in the first, second and third embodiments with the flange on the sides of the windshield on the left and for the windshield without the flanged sides on the right.
Figure 2:
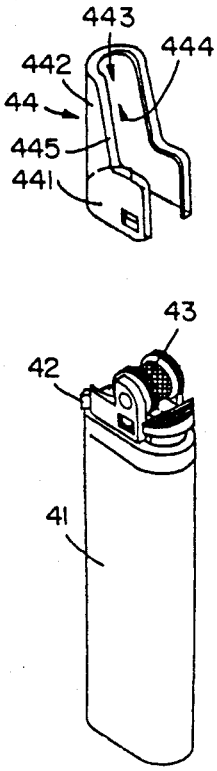
FIG. 2 is an exploded view of a first embodiment of the present invention.
Figure 3:
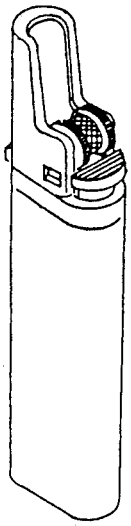
FIG. 3 is a perspective view of the first embodiment of the present invention with the windshield connected to the lighter.

The first embodiment of the invention is illustrated in FIG. 2 and FIG. 3. As shown, the present invention has a windshield 44 of suitable height on the top edge of the butane well housing, or case 41 of the lighter, or surrounding the nozzle (which is not shown here), or in between the top edge of the flame adjustment 42 and the two sides of the striker wheel 43.

The shape and size of the lower portion 441 of the windshield 44 is similar to that of FIG. 1. The upper portion 442 of the windshield 44 extends upward or outwardly to a suitable height from the lower portion 441 near the striker wheel 43, namely near the edge 311*a* of the nozzle portion 311 of the flame shield 31 of a regular disposable lighter as shown in FIG. 1. The suitable total height of the windshield is about 2–3 cm.

An opening 443 on top of the windshield 44 provides for heat dissipation from the flame during use. There is also an opening 444 on the side of the windshield facing toward the striker wheel in order that the air can convect naturally as the flame is burning.

At the edges of the openings 443 and 444 respectively on the top face and side face of the windshield 44 is provided a smooth, rounding, folding side or flange 445, having an appropriate width of about 2–4 mm. The cool air (should be cooler than the air inside the windshield 44 when the flame is burning) flowing along the sides of the windshield 44 and passing over the edge of the two sides of the windshield, naturally forms high pressure air and quickly flows to the opening 444 of the windshield 44. However, because of the hindrance of the folding side or flange 445 of the two sides of the opening 444, as shown in FIG. 2, the high pressure air flowing through the opening 444 is greatly reduced and the speed of the flowing air is also greatly decreased. Therefore, it is more effective to prevent or reduce the flame from being blown out on the nozzle portion 311 of the flame shield 31 than that for the windshield 2 of the prior known lighter of U.S. Pat. No. 4,531,906 without the flange on the sides. Because the windshield 44 is equipped with the folding side 445, and the surface of the folding side 445 is smooth and rounding, it prevents injury to the skin of a user.

The above described windproof lighter of the invention as a matter of fact, provides a fixed windshield 44 equipped with the folding sides, which replaces the flame shield 31 of the lighter 3 as shown in FIG. 1 and enhances the effect of preventing the wind from blowing out the flame. The present invention is therefore an improved lighter compared to the lighter of U.S. Patent 4,531,906 as shown in FIG. 1. Also, the present invention can save production costs.

Figure 6:
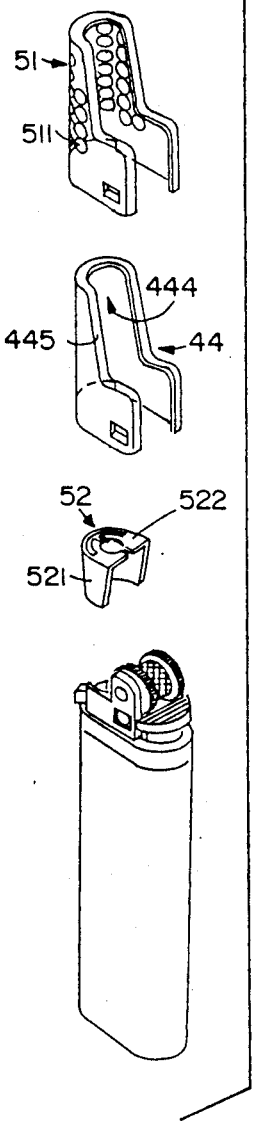
FIG. 6 is a perspective exploded view of a third embodiment of the present invention.
Figure 5:
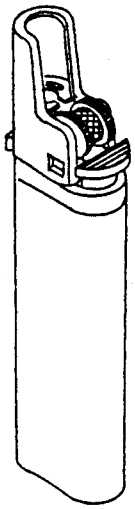
FIG. 5 is a perspective view of the second embodiment of the invention combined.
Figure 7:
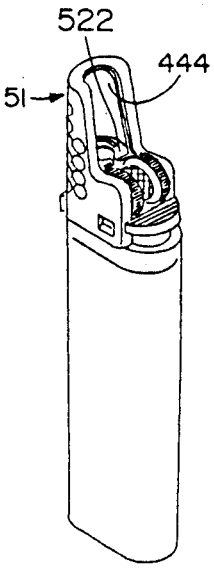
FIG. 7 is a perspective view of the third embodiment of the invention combined.

FIGS. 4, 5, 6 and 7 are second and third embodiments of the present invention, which are equipped with the extra shield cover 51 and the nozzle portion 52 with respect to the first embodiment. As shown in FIGS. 6 and 7, the surface of the shield cover 51 is equipped with multiple heat dissipation protrusions 511 which protrude inward slightly. The shield cover 51 with the dissipation protrusions 511 is similar to but slightly larger than the windshield 44. The shield cover 51 can be directly matched with and suited for the windshield 44 to prevent the user's skin from contacting directly with the windshield 44 and getting burned or injured because of the high temperature on the surface of the windshield 44.

Figure 4:
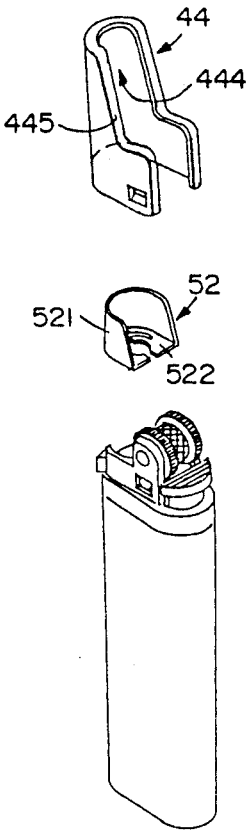
FIG. 4 is an exploded perspective view of a second embodiment of the invention.

As shown in FIGS. 4 and 6, the nozzle portion 52 consists of a semi-circular, or arclike, supplemental wall 521 and the nozzle gate 522, where the supplemental wall 521 is suitably shaped to conform to the inner surface of upper portion 442 of the windshield 44, such that the nozzle gate 522 is installed at the boundary between the upper portion 442 and the lower portion 441 of the windshield 44. As shown in FIGS. 6 and 7, the supplemental wall 521 also can be inverted to suit the inner edge of the lower portion 441 of the windshield 44, such that the nozzle gate 522 is installed in between the lower portion 441 and upper portion 442 of the windshield 44.

As shown in FIGS. 4, 5, 6 and 7, the nozzle gate 522 of the nozzle portion 52 has a similar shape to the nozzle gate 311 on the flame shield 31 of the regular disposable lighter 3 as shown in FIG. 1. It can maintain the point of the flame above the nozzle gate 522 of the nozzle portion 52 in order to avoid the flame from direct contact with the striker wheel 43 which can cause overheating of the striker wheel 43 within an extremely short time.

I claim:

1. A windproof lighter comprising:

a butane housing member having a top edge, a flame area and a striker means; and a windshield on said top of said housing member having a substantially U-shaped cross-section and partially surrounding said flame area, said windshield comprising a curved portion, substantially planar spaced side portions extending from said curved portion, said curved and side portions extending outwardly from said top edge of said housing member, a side opening facing said striker means, an outer opening over said flame area, edges on said curved and side portions at said openings, and smooth, rounded flange means on said edges extending into said openings; and a flame gate within said windshield.

2. A windproof lighter as claimed in claim 1 wherein:

said windshield extends outwardly from said top edge of said butane housing approximately 2–3 cm; and said flange means has a width in the direction of said opening of approximately 2–4 mm.

3. A windproof lighter as claimed in claim 1 and further comprising:

a shield cover on the outer surface of said windshield for protecting a user from direct contact with said windshield.

4. A windproof lighter as claimed in claim 3 and further comprising:

heat dissipation means on said shield cover.

5. A windproof lighter as claimed in claim 4 wherein:

said heat dissipation means comprises a plurality of inwardly protruding portions on said shield cover.

6. A windproof lighter comprising:

a butane housing member having a top edge and a flame area;

a windshield on said top edge of said housing member comprising a lower portion adjacent said top edge, an upper portion extending outwardly from said lower portion relative to said top edge, and an inner surface on said upper and lower portions partially surrounding the flame area;

a nozzle member within said windshield comprising a nozzle gate portion and a semi-circular shaped supplemental wall portion extending at an angle from said nozzle gate portion and having a shape substantially conforming to said inner surface of said windshield upper and lower portions so that when said nozzle member is installed within one of said upper and lower portions of said windshield said nozzle gate portion is positioned at the boundary between said windshield upper and lower portions; and a shield cover on said windshield for protecting a user from direct contact with the windshield.

7. A windproof lighter as claimed in claim 6 and further comprising:

heat dissipation means on said shield cover.

8. A windproof lighter as claimed in claim 7 wherein:

said heat dissipation means comprises a plurality of inwardly protruding portions on said shield cover.

9. A windproof lighter as claimed in claim 6 and further comprising:

a striker wheel means on said butane housing adjacent said top edge;

an opening on said windshield facing said striker wheel means;

a further opening at the outer region of said windshield upper portion; and edges on said openings.

10. A windproof lighter as claimed in claim 9 and further comprising:

a smooth, rounded flange on said edges extending inwardly of said openings.

11. A windproof lighter as claimed in claim 10 wherein:

said windshield extends outwardly from said top edge of said butane housing approximately 2–3 cm; and said flange has a width in the direction of said opening of approximately 2–4 mm.

* * * * *